US009267470B2

(12) United States Patent
Shinagawa

(10) Patent No.: US 9,267,470 B2
(45) Date of Patent: Feb. 23, 2016

(54) FUEL VAPOR PROCESSING APPARATUS

(71) Applicant: AISAN KOGYO KABUSHIKI KAISHA, Obu-shi, Aichi-ken (JP)

(72) Inventor: Masanobu Shinagawa, Ama (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 282 days.

(21) Appl. No.: 13/906,077

(22) Filed: May 30, 2013

(65) Prior Publication Data

US 2013/0319248 A1 Dec. 5, 2013

(30) Foreign Application Priority Data

Jun. 1, 2012 (JP) ..... 2012-126047

(51) Int. Cl.
*F02M 35/02* (2006.01)
*F02M 25/08* (2006.01)

(52) U.S. Cl.
CPC ..... *F02M 35/0218* (2013.01); *F02M 25/0854* (2013.01)

(58) Field of Classification Search
USPC ..... 96/143, 131; 123/518–521
See application file for complete search history.

(56) References Cited

U.S. PATENT DOCUMENTS

2004/0094132 A1* 5/2004 Fujimoto et al. ..... 123/519
2010/0154755 A1 6/2010 Ichikawa et al.

FOREIGN PATENT DOCUMENTS

| | | | |
|---|---|---|---|
| EP | 2199587 | A2 | 6/2010 |
| JP | 2002332922 | A | 11/2002 |
| JP | 2003278611 | A | 10/2003 |
| JP | 2009121357 | A | 6/2009 |
| JP | 2010144590 | A | 7/2010 |
| JP | 2012047150 | A | 3/2012 |

* cited by examiner

*Primary Examiner* — Adam W Bergfelder
(74) *Attorney, Agent, or Firm* — Conley Rose, P.C.

(57) ABSTRACT

A fuel vapor processing apparatus may include a container including an atmospheric introduction portion, through which the atmospheric air can be introduce into the container. An adsorption material may be contained in the container and configured to adsorb feel vapor and to allow the adsorbed fuel vapor to be desorbed as the atmospheric air introduced into the container flows through the adsorption material. A heater may directly or indirectly heat a part of the adsorption material located at an upstream end with respect to the flow of the atmospheric air.

9 Claims, 5 Drawing Sheets

FUEL VAPOR PROCESSING APPARATUS

This application claims priority to Japanese patent application serial number 2012-126047, the contents of which are incorporated herein by reference.

BACKGROUND OF THE INVENTION

1. Field of the Invention

Embodiments of the present invention mainly relate to fuel vapor processing apparatus, in which fuel vapor is adsorbed by an adsorption material contained in a container, the fuel vapor adsorbed by the adsorption material is desorbed (or purge) during driving of an engine, find a heater is provided for heating the adsorption material for promoting desorption of fuel vapor.

2. Description of the Related Art

A known fuel vapor processing apparatus configured as described above is disclosed in JP-A-2002-332922. The known fuel vapor processing apparatus has a container having an internal space divided into a main adsorption chamber and an auxiliary adsorption chamber. Each of the main and auxiliary adsorption chambers has an ad sorption material contained therein and also has a heater for heating the adsorption material. The main adsorption chamber communicates with a tank port and a purge port. The tank port is connected to a fuel tank that may produce fuel vapor. The purge port communicates with an intake pipe of an engine. The auxiliary adsorption chamber communicates with an atmospheric port for introduction of the atmospheric air. The tank port and the purge port communicating with the main adsorption chamber are positioned adjacent to each other. One side of the main adsorption chamber positioned further from the tank port and the purge port communicates with one side of the auxiliary chamber positioned further from the atmospheric port.

Fuel vapor produced within the fuel tank may enter the main adsorption chamber via the tank port and may be adsorbed by the adsorption material contained in the main adsorption chamber. Apart of the fuel vapor that has not been adsorbed by the adsorption material of the main adsorption chamber may flow from the main adsorption chamber into the auxiliary adsorption chamber and may be adsorbed by the adsorption material contained in the auxiliary adsorption chamber. As the engine is driven, the air may be drawn from, within the container into the engine via the purge port, so that air may flow into the container. In this way, the fuel vapor may be desorbed from the adsorption materials. As she fuel vapor is desorbed from the adsorption materials, the adsorption materials may be cooled to cause reduction in the adsorption ability. However, the heat of the heaters may inhibit such cooling of the adsorption materials.

After the engine has been stopped, desorption of fuel vapor by the flow of air may not occur. However, in this state, it may be necessary to inhibit fuel vapor that has been once adsorbed by the adsorption materials from being released to the atmosphere. To do this, it may be necessary to reduce in advance at least the fuel vapor adsorbed by a part of the adsorption material positioned near the atmospheric air introduction port. In order to enable this reduction, it may be necessary to design the heater to have a large heating capacity for promoting desorption. However, making the heating capacity larger is not preferable because the energy consumption may be increased.

Therefore, there has been a need in the art for a fuel vapor processing apparatus that can increase the fuel vapor desorption ability of a part of the adsorption material positioned nearer to the atmospheric air introduction, portion without need of increasing the heating capacity of the heater.

SUMMARY OF THE INVENTION

In one aspect according to the present teachings, a fuel vapor processing apparatus may include a container including an atmospheric introduction portion, through which the atmospheric air can be introduce into the container. An adsorption, material may be contained in the container and configured to adsorb fuel vapor and to allow the adsorbed fuel vapor to be desorbed as the atmospheric air introduced into the container flows through the adsorption material. A heater may directly or indirectly heat a part of the adsorption material located at an upstream end with respect to the flow of the atmospheric air.

DETAILED DESCRIPTION OF THE INVENTION

Figure 1:
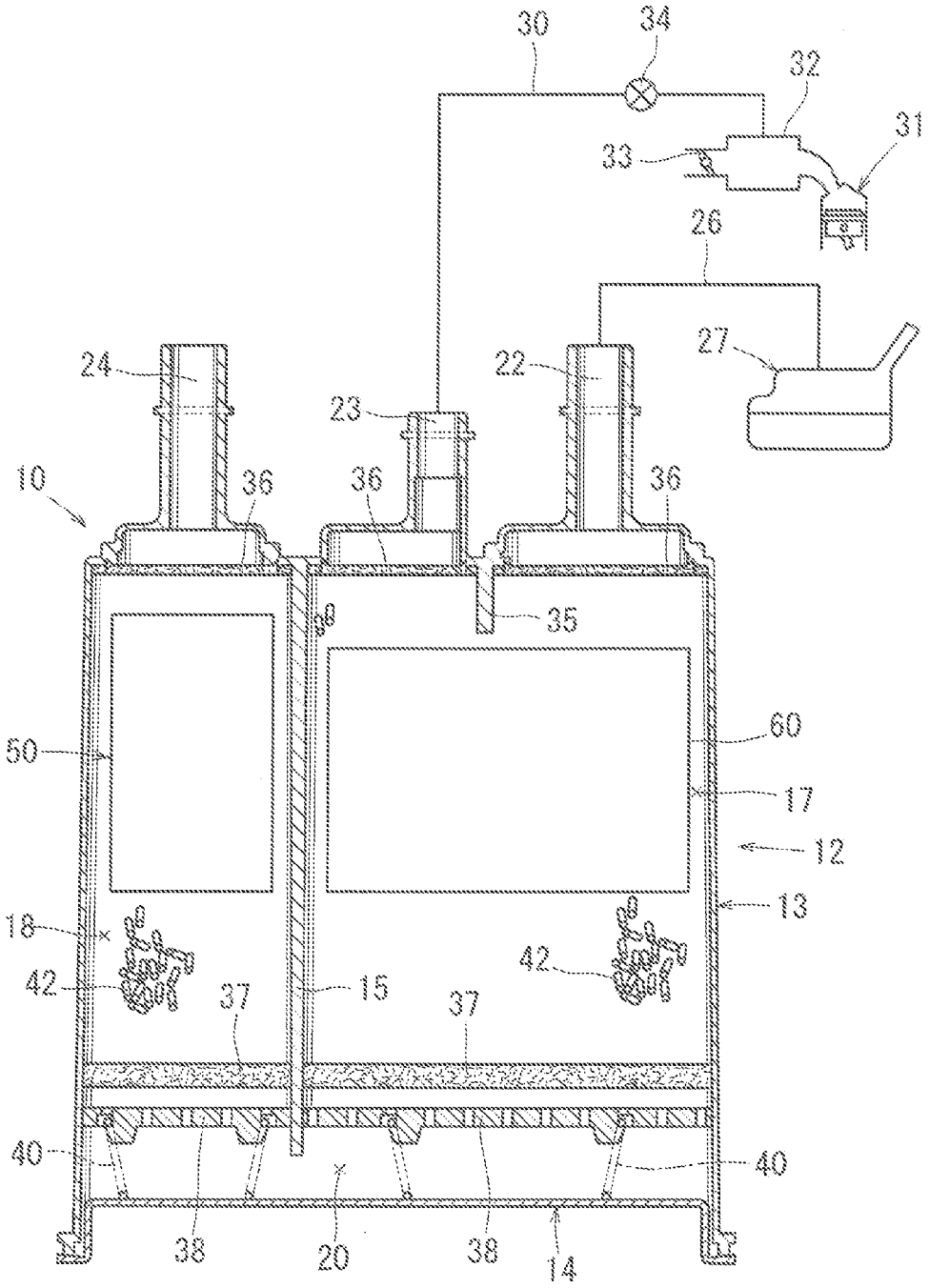
FIG. 1 is a schematic sectional view of a fuel vapor processing system incorporating a fuel vapor processing apparatus according to a first embodiment.

Each of the additional features and teachings disclosed above and below may be utilized separately or in conjunction with other features and teachings to provide improved fuel vapor processing apparatus. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one embodiment, a fuel vapor processing apparatus may include a container including an atmospheric air introduction portion, through which the atmospheric air is introduce into the container. An adsorption material may be contained in the container and configured to adsorb fuel vapor and to allow the adsorbed fuel vapor to be desorbed from the adsorption material as the atmospheric air introduced into the container flows through the adsorption material. A heater may be configured to heat the adsorption material for promoting desorption of fuel vapor. The adsorption material heated by the heater may have such a temperature distribution that a temperature of a part of the adsorption material located nearer to tire atmospheric air introduction portion of the container is higher than a temperature of the remaining part of the adsorption material.

With this arrangement, it is possible to reduce the amount of fuel vapor that may remain at the pan of the adsorption material located nearer to the atmospheric air introduction portion, without need of increase of the energy consumption of the heater as a whole. Therefore, it is possible to inhibit fuel vapor from being released from the adsorption material and discharged to the atmosphere during the time when the desorption process is not performed, for example, after stopping of an engine.

The container may further include a connecting portion for connection with an intake pipe of an engine. The adsorption material may include a first portion located nearer to the atmospheric air introduction portion of the container and a second portion located nearer to the connecting portion of the container. The heater may include a first heater configured to heat the first portion and a second heater configured to heat the second portion. A heating value of the first heater may be larger than a heating value of the second heater.

By providing two heaters, i.e., the first and second heaters, it may be possible to easily control the temperature of the adsorption material such that the temperature of a part of the adsorption material located nearer to the atmospheric air introduction portion of the container is higher than the temperature of the remaining pan of the adsorption material.

The first heater may be located within a space defined in the container at a position between the atmospheric air introduction portion and the adsorption material. With this arrangement, the first heater can be arranged regardless of the configuration the adsorption material. Therefore, the construction of the first heater can be simplified. In addition, the first heater may directly heat the air that may flow through the adsorption material daring the fuel vapor desorption process. Although the adsorption material may be cooled to cause reduction in the desorption efficiency as the fuel vapor is desorbed from the adsorption material, the heat of the first heater applied to the atmospheric air may inhibit such cooling of the adsorption material.

In another arrangement, the first heater may extend between the space and the adsorption material. Also with this arrangement, the atmospheric air may be directly heated by a portion of the first heater positioned within the space, and therefore, the heat of the first heater applied to the atmospheric air may inhibit cooling of the adsorption material during the desorption process. In addition, another portion of the first heater positioned at the adsorption material may directly heat the adsorption material. Therefore, the adsorption material may be quickly heated. For this reason, even in the case that the time for desorption is relatively short, desorption of fuel vapor may be rapidly performed. In this way, the fuel vapor desorption efficiency can be reliably maintained not to be lowered.

In a further arrangement, the first heater may be disposed at one end of the adsorption member on the side of the atmospheric air introduction portion. With this arrangement, a portion of the adsorption material, which is intended to be heated to the highest temperature, can be directly quickly heated. Therefore, the fuel vapor desorption efficiency can be reliably maintained not to be lowered.

In a still further arrangement, the first heater may be arranged to heat atmospheric air that flows into the container via the atmospheric air introduction portion. For example, the first heater may be located on an outer side of the container. This arrangement is advantageous because the arrangement and the maintenance work of the first beater can be easily performed in comparison with the arrangement where the first heater is located at the adsorption member. Also, because the heat of the first heater is directly applied to the air, the heat applied to the air may inhibit cooling of the adsorption material during the desorption process.

Embodiments of the present invention will be described with reference to the drawings.

First Embodiment

Referring to FIG. 1, there is shown a fuel vapor processing system incorporating a fuel vapor processing apparatus 10 according to a first embodiment. The fuel vapor processing apparatus 10 may be also called as a canister and may include a container 12 made of resin. The container 12 may include a rectangular tubular container body 13 and a closure member 14. The container body 13 may have a closed front end (upper end in FIG. 1) and an opened rear end (lower end in FIG. 1). The closure member 14 may be configured to close the opened rear end of the container body 13. A partition wall 15 may divide the internal space of the container body 13 into a main adsorption chamber 17 positioned on the right side and an auxiliary adsorption chamber 18 positioned on the left side. Each of the main adsorption chamber 17 and the auxiliary adsorption chamber 18 may have a rectangular tubular shape and may communicate with each other via a communication passage 20 defined within the rear end (lower end in FIG. 1) on the inner side of the closure member 14.

The front end (upper end in FIG. 1) of the container body 13 may be formed with a tank port 22 and a purge port 23 each communicating with the main adsorption chamber 17, and an atmospheric air introduction port 24 communicating with the auxiliary adsorption chamber 18. The tank port 22 may be connected to a gaseous region within a fuel tank 27 via a fuel vapor passage 26. The purge post 23 may be connected to as intake pipe 32 of an engine 31 via a purge passage 30. The engine 31 may be an internal combustion engine of a vehicle, such as an automobile, in this way, the purge port 23 may serve as a connection portion for connection with the intake pipe 32. The intake pipe 32 may have a throttle valve 33 that may control the flow rate of air supplied to the engine 31. The purge passage 30 may be connected to the intake pipe 32 at a position on the downstream side of the throttle valve 33. A purge valve 34 may be disposed in the purge passage 30 and may be opened and closed under the control of an engine control unit (ECU) (not shown). The atmospheric port 24 may be opened into the atmosphere and may serve as an atmospheric air introduction portion.

Front filters 36 may be respectively disposed at the front ends of the main adsorption chamber 17 and the auxiliary adsorption chamber 18. A separation wall 35 may separate the front end portion of the main adsorption chamber 17 into a right-side region communicating with the tank port 22 and a left-side region communicating with the purge port 23. Therefore, the front filters 36 that are two in number are respectively disposed at the right-side region and the left-side region of the front end of the main adsorption chamber 17. Rear filters 37 may be respectively disposed at the rear ends of the main adsorption chamber 17 and the auxiliary adsorption chamber 18. Each of the front and rear filters 36 and 37 may be formed of non-woven fabric made of resin or may be formed of urethane foam, etc. Perforated plates 38 may be respectively disposed within the main adsorption chamber 17 and the auxiliary adsorption chamber 18 at positions on the rear side (lower side in FIG. 1) of the rear filters 37 so as to extend along the rear surfaces of the rear filters 37. A spring 40 may be interposed between the closure member 14 and each of the perforated plates 38. The spring 40 may be a coil spring.

Granular adsorption materials 42 may be respectively filled within the main adsorption chamber 17 and the auxiliary adsorption chamber 18, more specifically, within spaces defined between the front filters 36 and the rear filters 37. The granular adsorption material 42 may be activate carbon granules. For example, the activated carbon granules may be broken activated carbon or may be granulated activated carbon manufactured by a granulation process of a mixture of granular or powder activated carbon and a binder.

A first heater 50 may be disposed within the auxiliary adsorption chamber 18 and may have a heat generation element that generates heat when electrically energized. The first heater 50 may have a shape like a rectangular sheet and may be located within the auxiliary adsorption chamber 18, more specifically, within a space defined between the front filter 36 and the rear filter 37, such that opposite sheet surfaces of the first heater 50 face upward and downward (the front and back direction with respect to a paper surface of FIG. 1) and the first heater 50 is embedded within the activated carbon granules of the adsorption material 42 of the auxiliary adsorption chamber 18.

A second heater 60 may be disposed within the main adsorption chamber 17. Similar to the first heater 50, the second heater 60 may have a heat generation element that generates heat when electrically energized. In addition, the second heater 60 may have a shape like a rectangular sheet and may be positioned with the main adsorption chamber 17 such that the opposite surfaces of the sheet face upward and downward and the first filter 50 is embedded within the activate carbon granules of the adsorption material 42 of the main adsorption chamber 17.

The power consumption of the first heater 50 may be set to be 15 watts, while the power consumption of the second heater 60 may be set to be 5 watts. Therefore, the heating value (heat generation amount) of the first heater 50 may be larger than that of the second heater 60. In this way, the temperature distribution of the adsorption materials 42 heated by the first heater 50 and the second beater 60 may be set such that the temperature of the adsorption material 42 heated by the first beater 50 and located nearer to the atmospheric port 24, through which the atmospheric an is introduced into the container 12 during the fuel vapor desorption process, is higher than the temperature of the adsorption material 42 contained in the main adsorption chamber 17 and heated by the second beater 60.

The operation of the fuel vapor processing system incorporating the fuel vapor processing apparatus 10 will now be described with reference to FIG. 1. The fuel vapor processing system may include the fuel vapor processing apparatus 10, the fuel vapor passage 26, the fuel tank 27, the purge passage 30, the intake pipe 32 and the purge valve 34.

When the engine 31 is stopped, the ECU may close the purge valve 34, so that fuel vapor produced within the fuel tank 27 may be introduced into the main adsorption chamber 17 via the fuel vapor passage 26 and the tank port 22. The adsorption material 42 of the main adsorption chamber 17 may then adsorb the introduced fuel vapor. If the adsorption material 42 of the main adsorption chamber 17 has not adsorbed a part of the introduced fuel vapor, such a part of the introduced fuel vapor may be introduced into the auxiliary adsorption chamber 18 and may be adsorbed by the adsorption material 42 of the auxiliary adsorption chamber 18.

During the driving operation of the engine 31, the ECU may open the purge valve 34, so that a negative pressure of the intake air may be applied to the purge port 23 of the container 12 of the fuel vapor processing apparatus 10, in conjunction with this, the atmospheric air (fresh air) may be introduced into the auxiliary adsorption chamber 18 via the atmospheric port 24. The air introduced into the auxiliary adsorption chamber 18 may desorb fuel vapor from the adsorption material 42 of the auxiliary adsorption chamber 18. The air may be further introduced into the main adsorption chamber 17 via the communication passage 20 and may desorb fuel vapor from the adsorption material 42 of the main adsorption chamber 17. The air containing the fuel vapor desorbed from the adsorption materials 42 may be discharged or purged into the intake pipe 32 via the purge passage 30 and may be subsequently burned in the engine 31.

During the desorption process of fuel vapor from the adsorption materials 42 of the auxiliary adsorption chamber 18 and the main adsorption chamber 17, a power source voltage may be applied to the heat generation elements of the first heater 50 and the second heater 60 via the ECU, so that the first and second heaters 50 and 60 generate heat. The heat generated by the first and second heaters 50 and 60 may be radiated to the adsorption materials 42 positioned around these heaters 50 and 60. Then, the fuel vapor adsorbed onto the surfaces of the adsorption materials 42 may be heated. In this way, it is possible to inhibit the adsorption materials 42 from being lowered in temperature by the endothermic reaction caused, when the fuel vapor is desorbed. As a result, it is possible to improve the fuel vapor desorption efficiency and to promptly recover the adsorption ability of the adsorption materials 42.

In addition, in this embodiment, the temperature of the adsorption material 42 located nearer to the atmospheric port 24 and heated by the first beater 50 may be higher than the temperature of the adsorption material 42 located within the main adsorption chamber 17 and heated by the second heater 60. Therefore, without accompanying increase in the total power consumption of the first heater 50 and the second heater 60, it is possible to inhibit the fuel vapor from being remained at the adsorption material 42 located nearer to the atmospheric port 24. Hence, it is possible to inhibit fuel vapor adsorbed by the adsorption material 42 located nearer to the atmospheric port 24 from being discharged to the atmosphere during the desorption process performed when the engine 31 is stopped.

In one example, the sum of the power consumption of the first heater 50 and the power consumption of the second heater 60 may be set to be the same as the power consumption of the heater of the known fuel vapor processing apparatus. Because the power consumption of the first heater 50 is larger than that of the second heater 60, it may be concerned if the thermal dose given by the second heater 60 is short. For example, if the thermal dose given by the second heater 60 is short, it may be possible that desorption of fuel vapor captured by the adsorption material 42 of the main adsorption chamber 17 is insufficient to the result that the adsorption ability of the main adsorption chamber 17 becomes lower. However, in the ease of the above embodiment, during the fuel vapor desorption process, the atmospheric air entering into the main adsorption chamber 17 via the auxiliary adsorption chamber 18 may be heated by the first heater 50 having a large power consumption. Hence, the heated atmospheric air may heat the adsorption material 42 of the main adsorption chamber 17. In this way, the desorption efficiency of the fuel vapor captured by the adsorption material 42 of the main adsorption chamber 17 may not become insufficient.

In addition, because the first heater 50 and the second heater 60 are provided separately from each other, it is possible to easily perform the temperature control for setting the temperature of the adsorption material 42 located nearer to the atmospheric port 24 to be higher than the temperature of the adsorption material 42 located in the main adsorption chamber 17.

Because the supply of electric power to the first heater 50 and the second heater 60 disposed within the container 12 may be performed via the ECU that may be located externally of the container 12, the electric wiring for the supply of electric power may extend through a portion of the container 12, which may be suitably chosen.

Second, third, fourth and fifth embodiments will now be described with reference to FIGS. 2 to 5. The second to fifth embodiments are modifications of the first embodiment. Therefore, in FIGS. 2 to 5, like members are given the same reference numerals as the first embodiment, and the description of these members will not be repeated.

Second Embodiment

Figure 2:
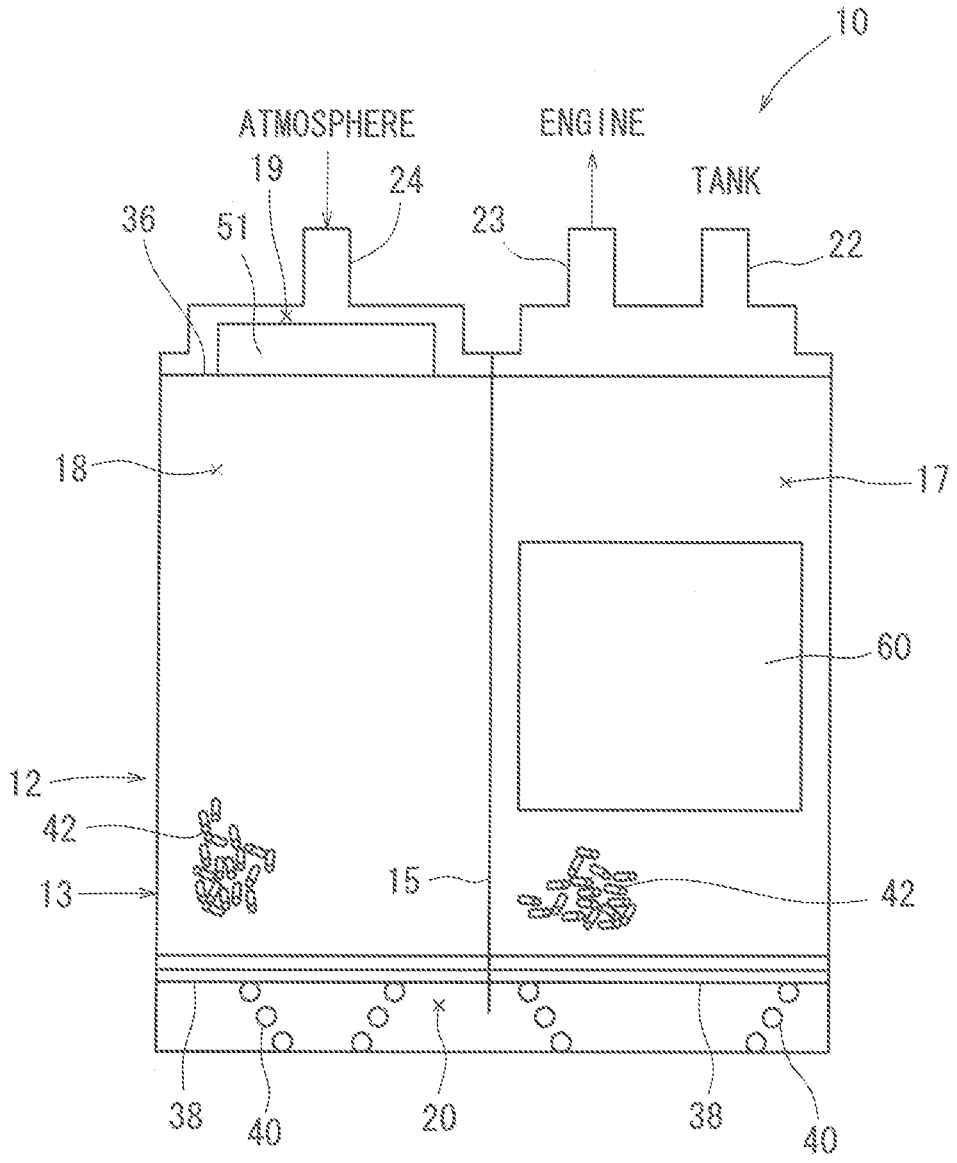
FIG. 2 is a schematic sectional view of a fuel vapor processing apparatus showing arrangement of heaters according to a second embodiment.

The second embodiment is shown in FIG. 2 and is different from the first embodiment in that a first heater 51 corresponding to the first heater 50 of the first embodiment is located within a space 19 defined between the atmospheric port 24 and the adsorption material 42 of the auxiliary adsorption chamber 18. As described previously, the filter 36 may be positioned to define the front end of the auxiliary adsorption chamber 18. Therefore, the first heater 51 may be positioned on the side of the atmospheric port 24 of the filter 36.

According to the second embodiment, the first heater 51 is located within the space 19 defined in the container 12. Therefore, the first heater 51 can be arranged independently of the arrangement of the adsorption material 42 of the auxiliary adsorption chamber 18. In addition, if is possible to simplify the construction of the first heater 51 than that of the first heater 50. Further, because the first heater 51 can directly heat the atmospheric air that may flow through the adsorption material 42 during the fuel vapor desorption process, it is possible to minimize the drop in temperature of the adsorption materials 42, which may be caused due to cooling by the flow of the atmospheric air through the adsorption materials 42 for desorption of fuel vapor.

When the atmospheric air does not flow into the atmospheric port 24, fuel vapor adsorbed by the adsorption materials 42 may be naturally released with time so as to be discharged to the atmosphere via the atmospheric port 24. However, in the second embodiment, the temperature of the adsorption material 41 becomes the highest at a front end part of the adsorption material 42, which is positioned nearer to the first heater 51 and located at the front end (upper end in FIG. 2) of the auxiliary adsorption chamber 18, i.e., the upstream end of the flow of atmospheric air through the auxiliary adsorption chamber 18. Hence, desorption of fuel vapor from the adsorption material 42 may be most promoted at the front end part of the adsorption material 42. Therefore, even in the case that the time for desorption is relatively short, desorption of fuel vapor may be rapidly performed. As a result, it may be possible to minimize the fuel vapor that is remained without being desorbed. In this way, it is possible to minimize the fuel vapor that may be discharge to the atmosphere via the atmospheric port 24.

Third Embodiment

Figure 3:
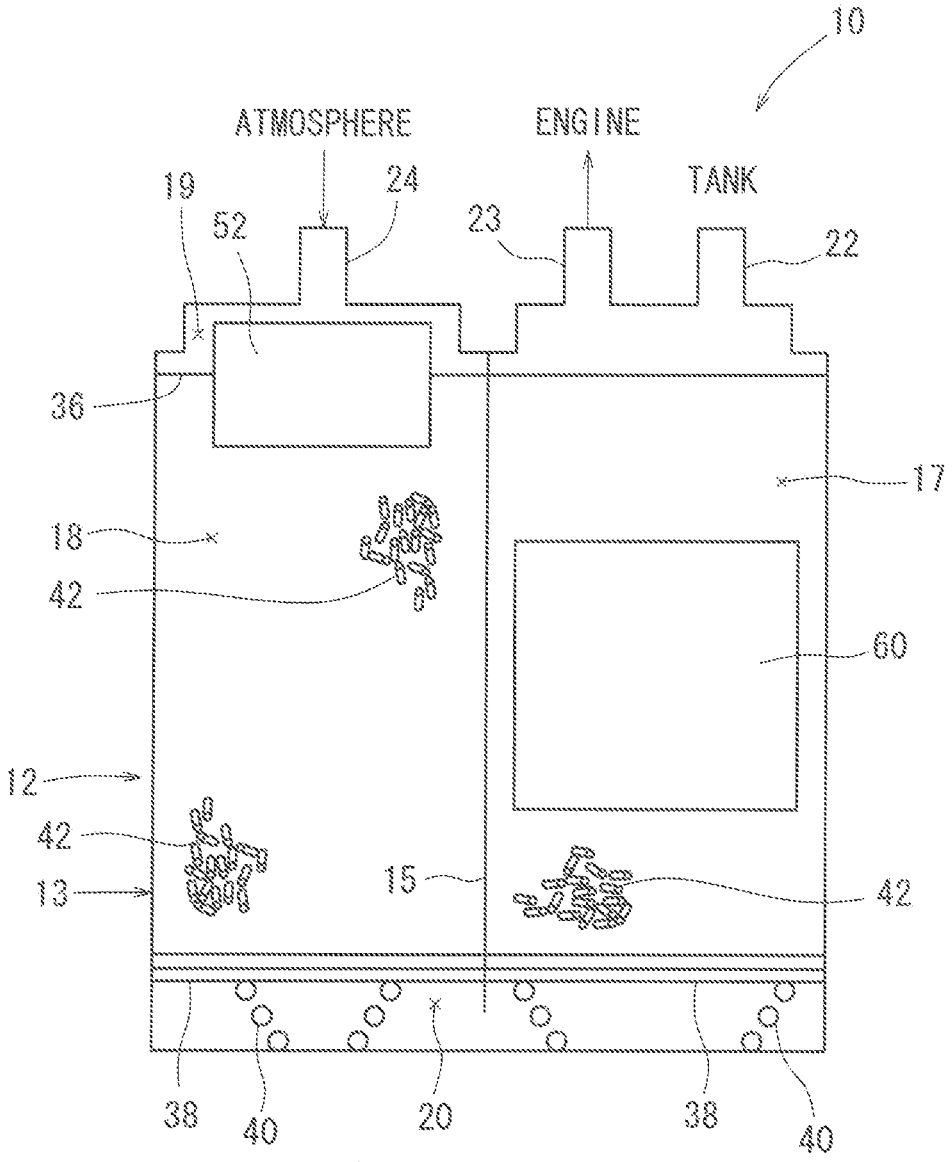
FIG. 3 is a schematic sectional view of a fuel vapor processing apparatus showing arrangement of heaters according to a third embodiment.

The third embodiment is shown in FIG. 3 and is different from the first embodiment in that a first heater 52 corresponding to the first heater 50 of the first embodiment extends between a part of the adsorption material 42 of the auxiliary adsorption chamber 18 located nearer to the atmospheric port 24 and the space 19 formed in the container 12 and communicating with the atmospheric port 24. In other words, the first heater 52 has one end embedded within the adsorption material 42 of the auxiliary adsorption chamber 18 and an opposite end positioned within the space 19.

As described previously, the front filter 36 may be positioned at the front end of the auxiliary adsorption chamber 18. Therefore, the first heater 52 may extend through the filter 36. It may be also possible to configure the first heater 52 from two separate heaters positioned on opposite sides (upper and lower sides in FIG. 3) of the filter 36.

According to the third embodiment, a part of the first heater 52 located within the space 19 may directly heat the atmospheric air that flows through the adsorption materials 42. Therefore, it is possible to minimize the drop in temperature of the adsorption materials 42, which may be caused by the atmospheric air that cools the adsorption materials 42 as it flows for desorption of fuel vapor. In addition, another part of the first heater 52 located within a part of the adsorption material 42 at the front end (upper end in FIG. 3) of the auxiliary adsorption chamber 18 may directly heat the adsorption material 42. Therefore, the adsorption material 42 can be quickly heated. In this way, it is possible to maintain the excellent desorption efficiency even in the case that the time for desorption of fuel vapor is relatively short.

Furthermore, according to the third embodiment, the temperature of the adsorption material 42 becomes the highest at a front end part of the adsorption material 42, which is positioned nearer to the first heater 52 and located at the front end (upper end in FIG. 3) of the auxiliary adsorption chamber 18, i.e., the upstream end of the flow of the atmospheric air through the auxiliary adsorption chamber 18. Hence, desorption of fuel vapor from the adsorption material 42 is most promoted at the front end part of the adsorption material 42. Therefore, even in the case that the time for desorption is relatively short, desorption of fuel vapor may be rapidly performed. As a result, it may be possible to minimize the fuel vapor that is remained without being desorbed. In this way, it is possible to minimize the fuel vapor that may be discharge to the atmosphere via the atmospheric port 24.

Fourth Embodiment

Figure 4:
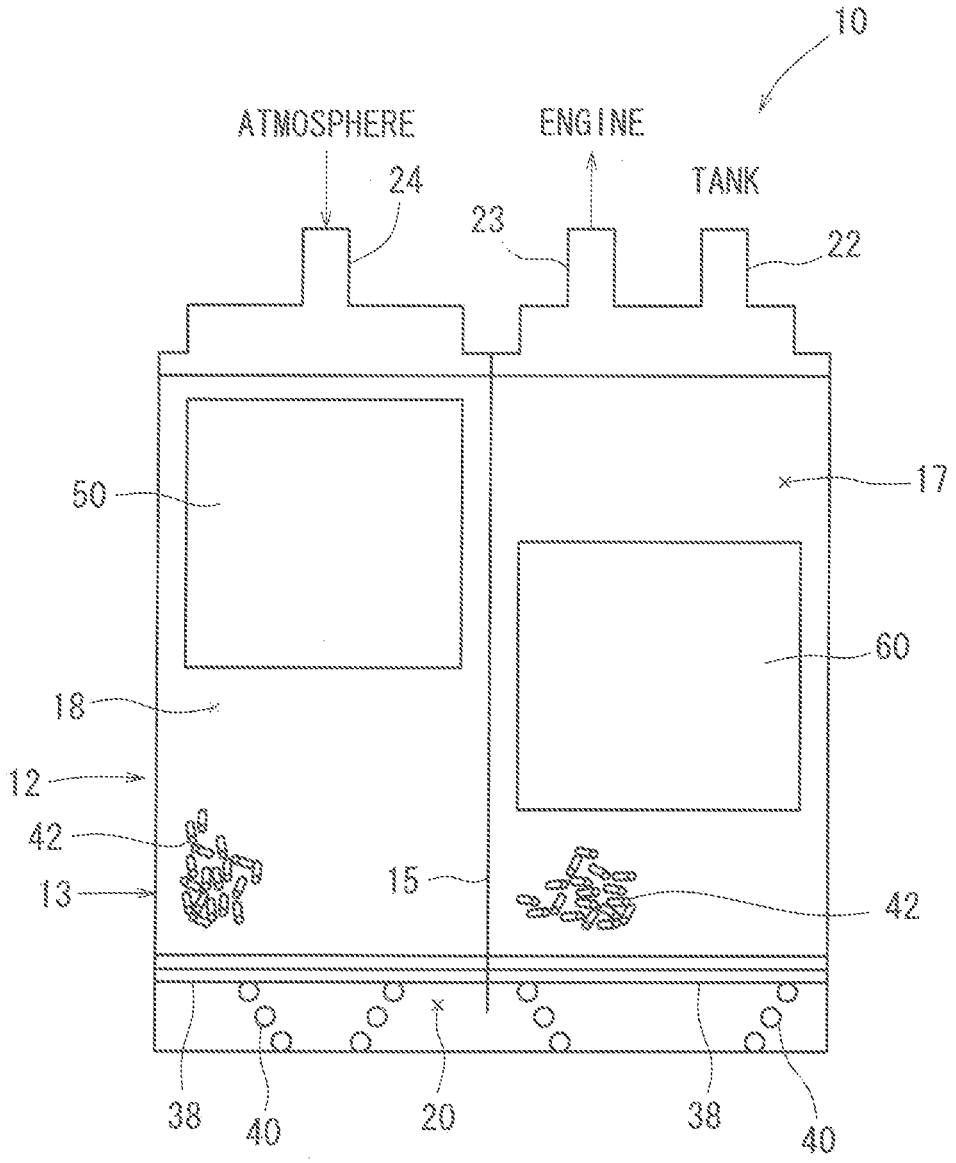
FIG. 4 is a schematic sectional view of a fuel vapor processing apparatus showing arrangement of heaters according to a fourth embodiment.

The fourth embodiment is shown in FIG. 4 and is different from the first embodiment in that the entire first heater 50 is positioned within a front side half region, of the auxiliary adsorption chamber 18 nearer to the atmospheric port 24.

With this arrangement, the first heater 50 can directly heat the adsorption material 42 including a front end part of the adsorption material 42 nearer to the atmospheric port 24. Therefore, the adsorption material 42 can be quickly heated. In this way, it is possible to maintain the excellent desorption efficiency even in the case that the time for desorption of fuel vapor is relatively short.

Fifth Embodiment

Figure 5:
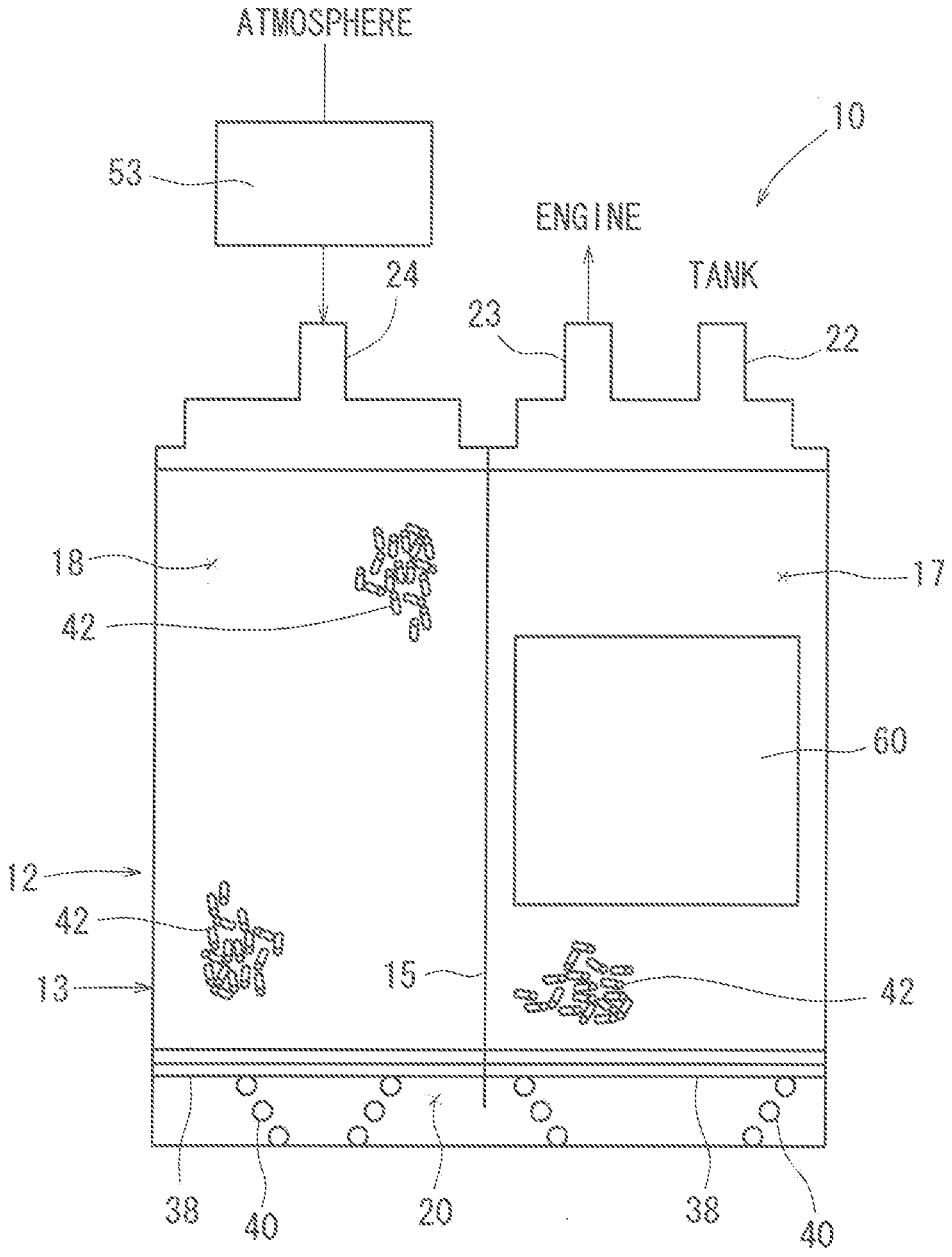
FIG. 5 is a schematic sectional view of a fuel vapor processing apparatus showing arrangement of heaters according to a fifth embodiment.

The fifth embodiment is shown in FIG. 5 and is different from the first embodiment in that a first heater 53 corresponding to the first heater 50 of the first embodiment is located for heating the atmospheric air before the atmospheric air flows into the auxiliary adsorption chamber 18. In this embodiment, the first heater 53 is located outside of the container 20. For example, the first heater 53 may be disposed within a pipeline (not shown) that supplies the atmospheric air to the atmospheric post 24. Alternatively, the first heater 53 may be located within the atmospheric port 24.

According to the fifth embodiment, the first heater 53 may be mounted within an outside pipeline or may be mounted within the atmospheric port 24 from the outside. Therefore, the operation for mounting the first heater 53 and the maintenance work for the first heater 53 can be easily performed. In addition, because the heater 53 can directly heat the atmospheric air that may flow through the adsorption material 42 during the fuel vapor desorption process, it is possible to minimize the drop in temperature of the adsorption materials 42 by the atmospheric air that may cool the adsorption materials 42 as it flows for desorption of fuel vapor.

Further, the temperature of the front end part of the adsorption material 42 located at the front end (upper end in FIG. 5) of the auxiliary adsorption chamber 18 may be the highest of the adsorption material 42. Hence, desorption of fuel vapor from the adsorption material 42 is most promoted at the front end part of the adsorption material 42. Therefore, even in the case that the time for desorption is relatively short, desorption of fuel vapor may be rapidly performed. As a result, it may be possible to minimize the fuel vapor that is remained without being desorbed. In this way, it is possible to minimize the fuel vapor that may be discharge to the atmosphere via the atmospheric port 24.

Possible Modification

The above embodiments may be modified in various ways. For example, the adsorption material 42 of each of the man adsorption chamber 17 and the auxiliary adsorption chamber 18 may be divided into two or more layers. Although the heaters 50 and 60 are configured to have heat generation elements that generate heat when a power source voltage is applied, the heaters 50 and 60 may be replaced with any other type of heaters, such as hot-water heaters that do not use an electric power as an energy source. Further, each of the first and second heaters 50 and 60 of each of the above embodiments may include a plurality of separate heaters.

What is claimed is:

1. A fuel vapor processing apparatus comprising:

a container including an atmospheric introduction portion, through which atmospheric air is introduce into the container, an adsorption material contained in the container and configured to adsorb fuel vapor and to allow the adsorbed fuel vapor to be desorbed from the adsorption material as the atmospheric air introduced into the container flows through the adsorption material; and a heater configured to heat the adsorption material for promoting desorption of fuel vapor, wherein the adsorption material heated by the heater has such a temperature distribution that a temperature of a part of the adsorption material located nearer to the atmospheric introduction portion of the container is higher than a temperature of the remaining part of the adsorption material;

wherein the container further includes an connecting portion for connecting with an intake pipe of an engine;

wherein the absorption material includes a first portion located nearer to the atmospheric air introduction portion of the container and a second portion located nearer to the connecting portion of the container;

wherein the heater comprises a first heater configured to heat the first portion and a second heater configured to heat the second portion; and wherein the first heater has a higher power consumption the second heater such that the first heater is configured to generate a larger amount of heat than the second heater when both the first heater and the second heater are heating the adsorption material.

2. The fuel vapor processing apparatus according to claim 1, wherein the container includes a space defined between the atmosphere air introduction portion and the adsorption material; and the first heater is located within the space.

3. The fuel vapor processing apparatus according to claim 1, wherein:

the container includes a space defined between the atmosphere introduction portion and the adsorption material; and the first heater extends between the space and the adsorption material.

4. The fuel vapor processing apparatus according to claim 1, wherein the first heater is disposed at one end of the adsorption material on the side of the atmospheric air introduction portion.

5. The fuel vapor processing apparatus according to claim 1, wherein the first heater is arranged to heat air that flows into the container via the atmospheric air introduction portion.

6. The fuel vapor processing apparatus according to claim 5, wherein the first heater is located on an outer side of the container.

7. The fuel vapor processing apparatus according to claim 1, wherein the first portion of the adsorption material comprises a first adsorption material, and the second portion of the adsorption material comprises a second adsorption material positioned apart from the first adsorption material.

8. The fuel vapor processing apparatus according to claim 1, wherein the first heater and the second heater are configured to simultaneously heat the first portion and the second portion of the adsorption material for promoting desorption of fuel vapor.

9. The fuel vapor processing apparatus according to claim 1, wherein the first heater and the second heater are configured to simultaneously heat the first portion and the second portion of the adsorption material during desorption of fuel vapor.

* * * * *